United States Patent [19]

Asada

[11] 4,022,671

[45] May 10, 1977

[54] ELECTROLYTIC COLORING OF ANODIZED ALUMINUM

[75] Inventor: Tahei Asada, Tokyo, Japan

[73] Assignee: Alcan Research and Development Limited, Montreal, Canada

[22] Filed: Apr. 20, 1976

[21] Appl. No.: 678,696

[52] U.S. Cl. ..... 204/42; 254/35 N

[51] Int. Cl.[2] ..... C25D 11/12; C25D 11/22

[58] Field of Search ..... 204/35 N, 42, 58

[56] References Cited

UNITED STATES PATENTS

| | | | |
|---|---|---|---|
| 3,382,160 | 5/1968 | Asada | 204/35 N |
| 3,844,908 | 10/1974 | Matsuo et al. | 204/35 N |

*Primary Examiner*—G. L. Kaplan

*Attorney, Agent, or Firm*—Cooper, Dunham, Clark, Griffin & Moran

[57] ABSTRACT

In the process of electrocoloring aluminum by passage of alternating current between anodized aluminum and a counter-electrode while immersed in a bath containing a salt of one or more of the group nickel, cobalt, tin, the range of colors obtainable by the process is extended by subjecting aluminum, which has been anodized under conventional D.C. conditions while immersed in a sulfuric acid-based electrolyte, to an electrolytic treatment in a phosphoric acid based electrolyte before the electrocoloring operation.

6 Claims, No Drawings

ELECTROLYTIC COLORING OF ANODIZED ALUMINUM

The present invention relates to the production of coloured anodic oxide films on aluminum (including aluminum alloys).

The colouring of anodic oxide films by electrolytic deposition of inorganic particles has become well known. One of the earliest descriptions of a process of this type is in German Pat. No. 741,753. The process as first put into commercial operation is described in U.S. Pat. No. 3,382,160 and British Pat. No. 1,022,927. Since those patents descriptions of very many different variants and improvements in the process have appeared in the patent literature.

In the electrocolouring process inorganic particles are deposited in the pores of an anodic aluminum oxide film (formed by application of D.C. in a sulfuric acid bath) by the passage of electric current, usually alternating current, between an anodised aluminum surface and a counterelectrode, whilst immersed in an acidic bath of an appropriate metal salt. The most commonly employed electrolytes are salts of nickel, cobalt, tin and copper. The counterelectrode is usually graphite or stainless steel, although nickel, tin and copper electrodes are also employed when the bath contains the salt of the corresponding metal.

The nature of the deposited particles has been the subject of much speculation and it is still uncertain whether the particles are in the form of metal or metallic oxide (or a combination of both).

Using, for example, a nickel sulfate electrolyte the colours obtained range from golden brown through dark bronze to black with increase in treatment time and applied voltage. It would be an obvious advantage to be able to provide a wider range of colours than is available at present.

Although many different salt solutions have been proposed for use in the electrocolouring of aluminum, it is found in practice that the best colour stability is achieved with baths containing nickel, cobalt or tin salts or sometimes mixtures of these salts.

In current commercial practice direct-current anodising in a sulfuric acid-based electrolyte has almost totally replaced all other anodising processes for the production of thick, clear, porous-type anodic oxide coatings, such as are employed as protective coatings on aluminum curtain wall panels and window frames, which are exposed to the weather. In general, anodising voltages employed for sulfuric acid-based electrolytes range from 12 to 22 volts depending upon the strength and temperature of the acid. Conventional sulfuric acid-based electrolytes include mixtures of sulfuric acid with other acids, such as oxalic acid and sulfamic acid, in which the anodising characteristics are broadly determined by the sulphuric acid content.

In the process of the present invention the anodic oxide film is produced by a conventional sulfuric acid process of the type discussed above to produce a film of typical thickness, for example in the range of at least 1 micron to 25 microns or more. The thus anodized aluminum is subjected to a further electrolytic treatment, which forms the special feature of the present invention, before being electrocoloured in a metal salt bath containing salts of one or more of the metals nickel, cobalt and tin, by passage of alternating current between the anodized aluminum and a counter-electrode, which is usually graphite or stainless steel, but may be nickel or tin where the salts of these metals form the predominating component of the electrocolouring bath.

It has long been recognized that the structure of an anodic oxide film is dependent upon the acid in which the anodizing operation is performed. Thus it is well recognized that anodization in sulfuric acid, oxalic acid, boric acid, chromic acid or phosphoric acid lead to the production of anodic oxide films which possess differences in barrier layer thickness, pore diameter and density and also differences in the rectifying characteristics of the film.

The present invention is concerned with the discovery that the colour of the film resulting from electrocolouring is different when anodization has been performed in a phosphoric acid electrolyte or in an electrolyte of which phosphoric acid is the major component as compared with the colour obtained when anodization has been performed in a conventional sulfuric acid electrolyte. Since it is difficult and indeed nearly impossible to produce an anodic film of adequare thickness by anodization in phosphoric acid, the present invention relies on first providing a conventional thick anodic film anodizing aluminum in sulfuric acid. The anodization of this film is then continued for several minutes in an aqueous phosphoric acid, such as orthophosphoric acid or pyrophosphoric acid, and finally the anodized aluminum is electrocoloured in an electrolyte containing a salt of one or more of the group consisting of nickel, cobalt, and tin. The metal salt is preferably a sulfate.

The aqueous phosphoric acid-based electrolyte in the second stage may contain a proportion of other acids, such as oxalic acid, sulfosalicyclic acid, sulfamic acid, chromic acid, tartaric acid, citric acid or gluconic acid or even a minor proportion of sulfuric acid.

The anodic oxidation treatment in a phosphoric acid-based electrolyte may be performed at a selected voltage in the range of 20–50 volts and preferably at a temperature in the range of 20°–35° C. The electrolyte may contain 50–150 gms/liter phosphoric acid, more preferably 80–120 gms/liter.

The film produced by this two-stage anodizing procedure may acquire colours in the range of gray through bronze to black by the deposition of microparticles in the pores of the anodic oxide film by the alternating current electrocolouring process in an electrolyte containing a salt of one or more of the metals Ni, CO, Sn. In a typical operation the above quoted range of colours is obtained by variation of the treatment time within the range of 20 seconds to 30 minutes.

The invention is illustrated by the following Examples.

EXAMPLE 1

Aluminum was first anodized under conventional conditions by the application of direct current at 17–18 volts to produce an anodic oxide film having a thickness of 15 microns. This was subjected to further electrolytic treatment under D.C. conditions for further formation of film in a bath containing phosphoric acid (80 g/l) and sulfuric acid (10 g/l) for 2 minutes. After rinsing the aluminum was treated under alternating current conditions in a bath containing nickel sulfate, $6H_2O$ (28 g/l), ammonium citrate (20 g/l) and boric acid (20 g/l) at pH 5.0 for the time and under the current density conditions described below in order to obtain aluminum with various colours. The counter-electrodes were graphite.

| | Current Density | Time | Colour. |
|---|---|---|---|
| 1) | 0.13 A/dm²(15 V) | 30 sec. | gold |
| 2) | 0.13 A/dm²(15 V) | 1 min. 30 sec. | blue |
| 3) | 0.25 A/dm²(17 V) | 4 min. | bronze |
| 4) | 0.3 A/dm²(17.5 V) | 6 min. | bronze |
| 5) | 0.3 A/dm²(18 V) | 12 min. | black |

After washing, the colour anodized aluminum was subjected to a conventional sealing treatment.

EXAMPLE 2

Aluminum, anodized in sulfuric acid as in Example 1, was subjected to further anodizing treatment in an electrolytic bath containing phosphoric acid (100 g/l) and sulfamic acid (50 g/l) at 25 volts D.C. for 3 minutes. After rinsing, the aluminum was treated under alternating current conditions in an electrolyte containing cobalt sulfate (25 g/l), tin (II) sulfate (4 g/l), ammonium tartarate (20 g/l) and boric acid (20 g/l) at pH 7.5 for the time and under the current density conditions described below. The counter-electrodes were stainless steel sheets.

| | Current Density | Time | Colour |
|---|---|---|---|
| 1) | 0.11 A/dm² (15 V) | 45 sec. | blue |
| 2) | 0.18 A/dm² (16 V) | 4 min. | light bronze |
| 3) | 0.23 A/dm² (16.5 V) | 5 min. | dark brown |
| 4) | 0.28 A/dm² (17 V) | 10 min. | black |

After washing the colour anodized aluminum was subjected to a conventional sealing treatment.

EXAMPLE 3

Aluminum, anodized in sulfuric acid as in Example 1, was subjected to further anodizing treatment in an electrolytic bath containing pyrophosphoric acid (120 g/l), and oxalic acid (20 g/l) for 3 minutes. After washing, said aluminum was treated with an alternating current in an electrolyte containing nickel sulfate (25 g/l), sulfosalicylic acid (25 g/l) and ammonium sulfate (10 g/l) at pH 7.5 for the time and under the current density conditions described below. The counter-electrodes were spaced nickel rods.

| | Current Density | Time | Colour |
|---|---|---|---|
| 1) | 0.13 A/dm² (15 V) | 20 sec. | gold |
| 2) | 0.2 A/dm² (15 V) | 1 min. 15 sec. | greyish blue |
| 3) | 0.28 A/dm² (17.5 V) | 4 min. | bronze |

-continued

| | Current Density | Time | Colour |
|---|---|---|---|
| 4) | 0.32 A/dm² (18 V) | 12 min. | black |

After washing, the colour anodized aluminum was subjected to a conventional sealing treatment.

As described in detail in the foregoing sections and in examples, anodized films formed on the surface of aluminum in a sulfuric acid bath were improved further in their character for deposition of particles in electrocolouring by the treatment with phosphoric acid. Aluminum with blue and greyish blue colours (which cannot be obtained by the conventional method) and also light bronze to black can be obtained from the same (i.e. single) electrolytic bath.

Other baths that may be employed for performing the colouring stage may contain nickel sulfate and tin (II) sulfate in relative proportions of about 2:1, together with tartaric acid in an amount of 15–30 g/l. Optionally the bath may contain an ammonium salt, such as ammonium sulfate, and in some instances it may be desirable to add a magnesium salt, particularly magnesium sulfate.

I claim:

1. A process for the production of a coloured anodized aluminum article which comprises forming a porous anodic oxide film of at least 1 micron thickness on aluminum by direct current anodizing in a sulfuric acid-based electrolyte, continuing the anodization of the anodized aluminum under direct current conditions in a phosphoric acid-based electrolyte and finally subjecting the anodized aluminum to passage of alternating current between itself and a counterelectrode while immersed in a bath containing a salt of at least one metal selected from the group consisting of nickel, cobalt and tin.

2. A process as claimed in claim 1 in which the phosphoric acid-based electrolyte contains 50–150 gms/liter. phosphoric acid.

3. A process as claimed in claim 2 in which the phosphoric acid-based electrolyte contains at least one additional acid selected from the group consisting of oxalic acid, chromic acid, sulfosalicylic acid, sulfamic acid, tartaric acid, citric acid, gluconic acid and sulfuric acid.

4. A process as claimed in claim 2 comprising subjecting the sulfuric acid-anodized aluminum to direct current treatment in the phosphoric acid-based electrolyte at a voltage of 20–50 volts.

5. A process as claimed in claim 4 further comprising maintaining the phosphoric acid-based electrolyte at a temperature in the range of 20°–35° C.

6. A process as claimed in claim 1 comprising subjecting the anodized aluminum to alternating current for a period of 20 secs. to 12 minutes.

* * * * *